US005303461A

United States Patent [19]

Okey et al.

[11] Patent Number: 5,303,461

[45] Date of Patent: Apr. 19, 1994

[54] THERMAL PROTECTION FOR ELECTRICAL MACHINES

[75] Inventors: David W. Okey, Rockford, Ill.; Joseph F. Leicht, Placentia, Calif.; Francis T. Carriglitto, Rockford, Ill.; Colum O'Hare, San Diego, Calif.; Keith E. Garr; Lawrence J. Kintz, Jr., both of Rockford, Ill.

[73] Assignee: Sundstrand Corporation, Rockford, Ill.

[21] Appl. No.: 9,822

[22] Filed: Jan. 27, 1993

[51] Int. Cl.[5] ..... H01H 11/00

[52] U.S. Cl. ..... 29/622; 29/460; 427/461; 427/185; 337/380

[58] Field of Search ..... 29/622, 460; 337/380, 337/381; 427/459, 461, 185; 174/50.5

[56] References Cited

U.S. PATENT DOCUMENTS

| | | | |
|---|---|---|---|
| 3,474,372 | 10/1969 | Davenport et al. | 337/1 |
| 3,764,765 | 10/1973 | Olashaw | 174/15.3 |
| 3,834,927 | 9/1974 | Putney | 427/185 |
| 4,013,988 | 3/1977 | Holden | 337/377 |
| 4,086,558 | 4/1978 | Pejouhy et al. | 337/102 |
| 4,167,721 | 9/1979 | Senor et al. | 337/112 |
| 4,203,194 | 5/1980 | McGrath | 427/461 |
| 4,571,518 | 2/1986 | Kintz, Jr. et al. | 310/68 R |

FOREIGN PATENT DOCUMENTS

| | | | |
|---|---|---|---|
| 4-163815 | 6/1992 | Japan | 29/622 |

*Primary Examiner*—P. W. Echols

*Attorney, Agent, or Firm*—Wood, Phillips, VanSanten, Hoffman & Ertel

[57] ABSTRACT

Long thermal paths and the resulting slow response times in sealed and electrically insulated thermal sensors may be substantially reduced by insulating and sealing the sensor (26) by a method which includes the steps of providing (30) an electrostatic fluidized bed of electrically insulating resin; locating (34) the sensor (26) at the bed; coating (36) the sensor (26); removing (38) the sensor from proximity to the bed; and curing (40) to the resin to form a uniform, thin coating encapsulating the sensor (26).

12 Claims, 2 Drawing Sheets

THERMAL PROTECTION FOR ELECTRICAL MACHINES

FIELD OF THE INVENTION

This invention relates to thermally protecting electrical machines, and more specifically, to the protection of electrical machines having electrical windings such as motors, generators, transformers, solenoids, transformers, and the like.

BACKGROUND OF THE INVENTION

Many electrical machines having electrical windings have a requirement for high reliability. While this requirement is widespread in many different types of electrical machines including motors, generators, solenoids, transformers and the like, in the case of motors or generators utilized in aircraft, the difficulty of repair in service as well as the need for unfailing operation in flight demands the highest quality and reliability of the motor or generator.

One way in meeting the requirements in aircraft is the known use of redundant systems and the provision of some means of shutting down a motor or generator if a problem occurs to prevent damage from occurring or at least to minimize the damage so that any needed repair is absolutely minimized or eliminated all together.

Typically, a problem will manifest itself by increased current flow within the machine which, in turn, results in increased heat generation. As a consequence, the temperature of the machine stator (as well as the rotor) will increase. This increase in temperature is conventionally sensed through the use of thermal protectors placed in the end turns of the stator windings of the machine. The thermal protectors may be in the form of fuses placed in series with the electrical circuit in which the dynamoelectric machine is located or they can be thermistors whose resistance changes with temperature and which are employed with a logic circuit to shut the dynamoelectric machine down when a certain temperature level is reached.

More common is the use of a small thermal switch located in the end turns of the stator winding. The switch is typically a very small bimetal switch and is configured so as to open or close when a certain temperature is reached. The opening or closing of the switch, in turn, opens or closes an electrical circuit which is then employed with other equipment to shut down the dynamoelectric machine before it overheats to the point of severe damage, and preferably before it overheats to the point of any damage whatsoever.

Upon shut down of the machine, the high temperature gradually dissipates and ultimately, the switch will revert back to its original condition, restoring the electrical circuit to its former state. This can be used as a means to automatically reset the motor shut down circuit and thus avoids any need to change fuses or the like to restore the motor to service.

To sense increasing temperature in an electrical machine, switches of the type mentioned are typically placed in the end turns of the windings of the machine stator. Because the switches universally include metal, they must be electrically isolated from the electrical circuit including the winding of the stator. This requirement, however, has led to system difficulties.

Specifically, if the insulation placed on the switch to isolate the switch from the stator windings is too thick, heat flow from the windings to the switch will be impeded. As a consequence, an undesirably high temperature may be reached in the windings and yet a substantial period of time may elapse before that temperature is sensed by the switch, giving rise to the opportunity for substantial electrical damage to the machine to occur in the interim.

Moreover, insulating the switches by common methods employed today complicates manufacture of the machines. Commonly used methods include wrapping the switch in various dielectric materials. See, for example, commonly assigned U.S. Pat. No. 4,571,518 issued Feb. 18, 1986 to Kintz et al. Another method employed is to "pot" the switch by molding a paste of potting compound around the switch. Both approaches require excessive manufacturing time due to the need to mix, handle, pot and cure the material. Further, either approach typically results in a relatively long thermal path from the end turns to the switch itself, frequently on the order of 20 to 30 thousandths of an inch or longer. Consequently, the time for the machine to tripout upon an overheated condition will be longer than desired and frequently can be excessive.

Still a further difficulty presents itself with the use of switches insulated by these methods. Because the methods result in a relatively large mass of insulation located about the switch, the size of the assembly to be inserted between end turns is larger than is desired. Consequently, individual wires in the end turns must be subjected to substantial force to be moved out of the way to create a pocket into which the switch can be inserted. During this process, the wires may be nicked or damaged by the tools used to form the pocket and this, in turn, has the potential effect of causing short circuits later when the motor is tested or placed in use. Consequently, a much smaller switch assembly mass is highly desirable.

Still another difficulty may attend the fabrication process. The switches that are used are very small. Typically, they may be shaped like a cylindrical disk and have a diameter of 3/10 of an inch and a thickness of only 1/10 of an inch. Purportedly, such switches are hermetically sealed at the source. However, long experience with such switches has caused many experienced manufacturing people to reach the opinion that a significant number of the switches may not remain hermetically sealed when subjected to a vacuum. Consequently, when the machine windings are exposed to vacuum during impregnation with varnish for insulation purposes, the varnish can conceivably infiltrate the switch if it is not hermetically sealed. When that occurs, the varnish within the switch may impede or even prevent the switch from changing its condition from open to closed, or vice versa, in response to temperature changes. When that occurs, the protection for the electrical machine that is desired becomes non-existent.

As a consequence, the manufacturing processes employed by the assignee of the present application include the assumption that the switch is not initially hermetically sealed, and further require that the insulating wrap around the switch provides a coating which will prevent varnish infiltration during the impregnation process. As a consequence, an expensive, multistage manufacturing process is required to assure that none of the previously stated circumstances will affect quality and performance of the electrical machines. Unfortunately, however, the use of the various steps deemed necessary is reflected in the cost of the machine to the customer.

The present invention is directed to overcoming the above problem.

SUMMARY OF THE INVENTION

It is the principal object of the invention to provide a new and improved temperature sensor for placement in the windings of an electrical machine. More specifically, it is an object of the invention to provide such a switch that is sealed and insulated and which nonetheless has a much shorter thermal path than switch assemblies heretofore known.

An exemplary embodiment of the invention achieves the foregoing objects in a method of sealing a temperature sensor having a nominally sealed housing which comprises the steps of:

a) providing a fluidized bed of resin particles;

b) disposing the sensor to be sealed in proximity to the bed;

c) causing particles of resin from the bed to adhere to the sensor until a desired thickness of particles on the switch is achieved; and d) fusing the particles into a unitary mass encapsulating the sensor.

As a result of the foregoing process, a uniform coating of particles on the sensor may be achieved, and because of the uniformity that may be achieved, the coating may be generally quite thin in comparison to prior art potted coatings and yet provide the necessary insulation and sealing. Because of the thinness of the coating, the thermal path to the sensor is reduced.

In a highly preferred embodiment, the sensor is a bi-metallic switch.

In a preferred embodiment, a step of adhering particles from the fluidized bed to the sensor is performed using electrostatic attraction. Preferably, the fluidized bed is an electrostatic fluidized bed.

Alternatively, a step of adhering particles of resin to the sensor may be performed by heating the sensor to a temperature sufficiently high that resin particles contacting the sensor will become tacky and adhere thereto. In a highly preferred embodiment of the invention, the resin employed is a thermosetting resin.

The best mode of the invention contemplates a method of sealing a bimetallic switch which includes the steps of:

a) Providing an electrostatic fluidized bed of particles of a thermosetting resin at a particular electrical charge;

b) grounding or applying the opposite electrical charge to the housing of the switch to be sealed;

c) locating the switch to be sealed in sufficiently close proximity of the electrostatic fluidized bed as to attract particles from the bed to the switch;

d) continuing step c) until the switch to be sealed is uniformly coated to a desired depth;

e) removing the switch from the proximity to the electrostatic bed; and f) curing the resin.

Preferably, where needed, step e) is followed by, and step f) is preceded by the step of removing resin from unwanted areas of the switch.

In one embodiment, the step of removing resin is performed by brushing the resin particles from the unwanted areas. In another embodiment, the step of removing resin is performed by directing a stream of air onto areas of the switch in which resin is not desired.

In one embodiment of the invention, step f) is followed by the step of inserting the switch in between coils of an electrical winding.

In a highly preferred embodiment, the winding is the stator winding of a dynamoelectric machine.

A preferred embodiment of the invention contemplates the use of an epoxy resin.

Other objects and advantages will become apparent from the following specification taken in connection with the accompanying drawings.

DESCRIPTION OF THE PREFERRED EMBODIMENT

Figure 1:
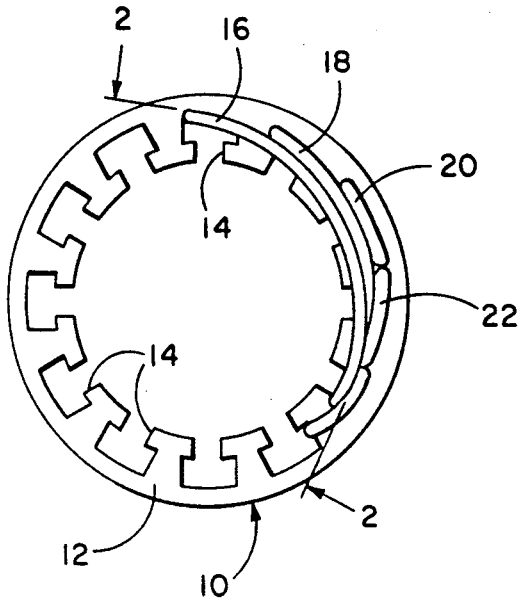
FIG. 1 is a side elevation of a stator for a dynamoelectric machine protected with a switch made according to the invention.
Figure 2:
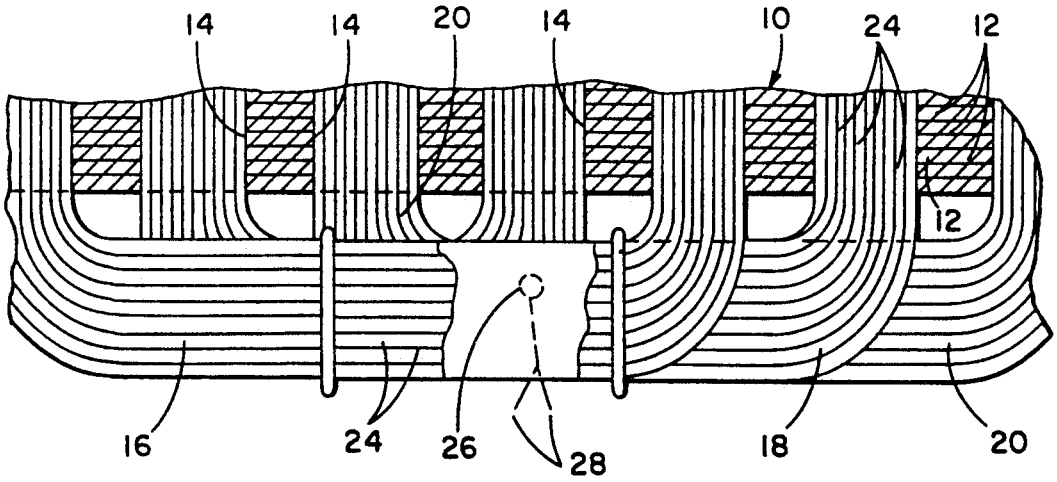
FIG. 2 is a sectional view taken approximately along the line 2—2 in FIG. 1.

One exemplary use of the product of the method of the invention is illustrated in FIGS. 1 and 2 in the environment of a stator 10 of a dynamoelectric machine. The stator 10 includes a series of ring-like iron laminations 12 having radially inwardly opening T-shaped slots at equally angularly spaced locations about the laminations 12.

As is well known, sets of end turns emerge from each of the slots 14 and are turned angularly to re-enter a different slot 14 at some predetermined angular relation to the original slot. For example, as seen in FIG. 1, in a three phase machine, one set 16 of end turns emerges from the radially outer part of a slot 14 and traverses at an angular distance of approximately 120° to enter another slot 14 at a radially inner point. A second set of end turns 18 emerges from a slot 14 adjacent that from which the set 116 emerges and extends angularly approximately 120° to re-enter the radially inner portion of another one of the slots 14. This relationship is carried out by additional sets 20, 22, etc. of end turns in a conventional fashion which results in the sets 16, 18, 20, 22, etc. being staggered with respect to one another. The relationship is also shown in a developed sectional view such as seen in FIG. 2. As is conventional, each of the sets 16, 18, 20 and 22 is made up of individual conductors or wires 24 which typically are varnished for insulation purposes. Thus, the stator 10 is provided with windings made up of the wires 24 which in turn provide a number of sets 16, 18, 20, 22, etc. of end turns of the Windings as they emerge from the slots 14 in the iron laminations 12. As is well known, a temperature sensor or switch 26 may be located within the windings, specifically, one or more of the sets 16, 18, 20, 22, etc. of the end turns. The sensor 26 includes electrical leads 28 which will be collected into an electrical circuit of known construction that is operative to shutdown operation of the dynamoelectric machine when the sensor 26 senses that the temperature within the end turn sets 16, 18, 20, 22, etc. has reached or is exceeding some predetermined level.

In the usual case, the sensor 26 will be a bimetallic switch. One type of such switch that may be used with efficacy is that a sold under the trademark or tradename "Tiny Stats" by Texas Instruments. These bimetallic switches are generally disk-shaped having a diameter on the order of 3/10 of an inch and a height of approximately 1/10 of an inch. According to the manufacturer, they are hermetically sealed switches. In the experience of the assignee of the instant application, however, while the switches are hermetic under normal atmospheric conditions, a significant number of the switches may not remain hermetically sealed when subjected to a vacuum. Accordingly, the switches must be characterized as nominally sealed or nominally hermetically sealed switches.

These switches include an internal bimetal as well as a metallic housing which is crimped to provide the nominal seal. Because of the metal construction, it is necessary that the sensor 26 be insulated so that electrical isolation from the circuit or circuits including the individual wires 24 is assured.

In addition, it is necessary that the sensor 26 be sealed so as to prevent the entry of any varnish into the interior of the switch during impregnation of the stator 10.

It is also highly desirable that the relatively small dimensions of the sensor 26 as mentioned previously be maintained as nearly as possible so as to minimize the need for shifting the individual wires 24 in the particular set or sets of end turns 16, 18, 20, 22, etc. at which the sensor 26 is to be embedded. Minimizing this dimension is also important in minimizing the length of the thermal path from the wires 24 in which heat is generated by current flow and the bimetal within the sensor 26 which is the heat reactive component thereof operative to provide the desired signal that ultimately halts operation of the machine. A minimal thermal path will maximize sensor response.

Figure 3:
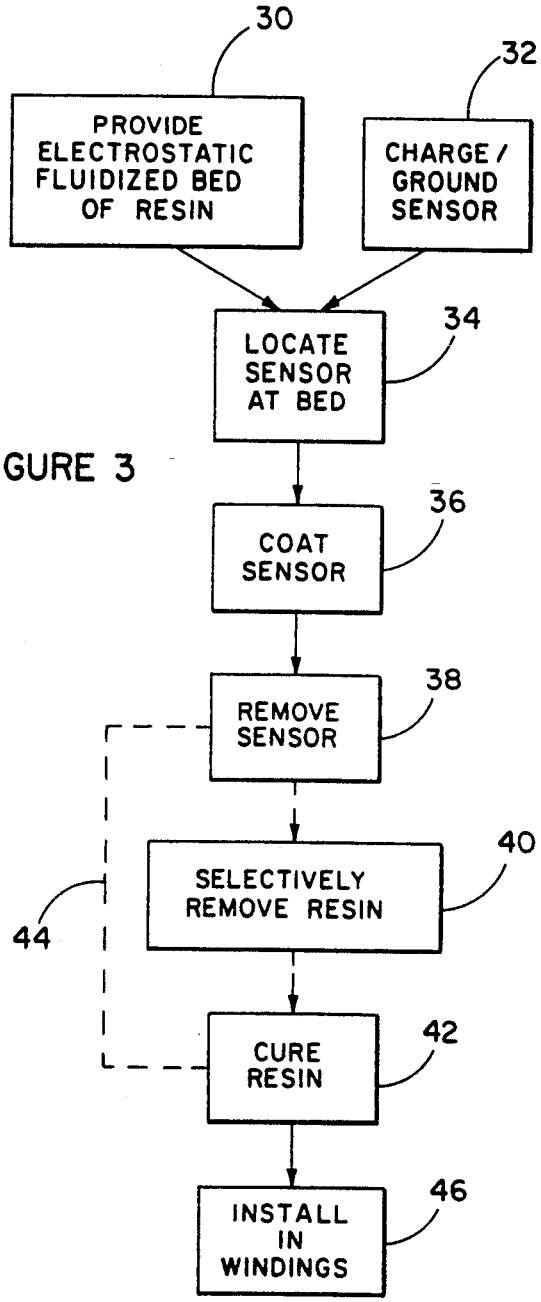
FIG. 3 is a block diagram illustrating steps in the inventive method.

By the method of the invention, an exemplary embodiment of which is illustrated in FIG. 3, these desirable features are obtained.

According to the invention, the sensor 26 is first coated with a resin having the characteristic of being electrically insulating. Preferably, the resin will be a thermosetting resin. However, it is possible that thermoplastic resins may be used in some instances so long as their softening or melting points are well above the temperature at which the sensor 26 will operate to ultimately cause shutdown of the machine. This is due to the fact that if the softening or melting point of a thermoplastic resin were too close to the activation temperature of the sensor 26, it is possible that the softening or melting temperature of the resin could be reached before operation of the sensor 26 to cause shutdown of the machine which, in turn, could result in flow of the resin from the housing of the sensor 26, allowing one or more of the wires 24 to come in contact therewith.

In a preferred embodiment of the invention, the resin employed is a one part epoxy resin having good electrical characteristics such as good electrical resistance. One example of such a resin is that sold by the Electrical Specialties Division of 3M Company as Scotchcast powder resin, product number 5230. This resin is a good electrical insulator that is specifically formulated for electrostatic fluid bed application.

The resin is a one part resin in powder form and thus each particle of the powder contains all the components necessary to effect a complete cure and obtain the performance properties stated by its manufacturer.

This resin is placed in an electrostatic fluidized bed such as those available from Electrostatic Technology, Inc. of Branford, Conn., U.S.A. As is well known, in such a fluid bed, the resin particles are aerated in a fluidizing chamber and are electrostatically charged, typically negatively, by ionized air forced through a porous plate at the base of the fluidizing chamber. As the powder particles become charged, they repel each other to such a degree that they rise above the chamber forming a cloud or veil of charged particles.

This step in the method is illustrated by the box 30 in FIG. 3.

At the same time, the sensor 26 is either positively charged, or more likely, simply grounded. This step is indicated at block 32 in FIG. 3.

Once charged or grounded, the sensor 26 is placed in the cloud of charged particles in the fluidized bed as schematically illustrated at the box 34 in FIG. 3. Because of the different electrostatic potential between the resin particles and the sensor 26, the particles are attracted to the sensor 26 and attach to it to form a uniform coating. This occurrence is shown by the box 36 in FIG. 3. Desirably, the process is such that the resin particles are more attracted to exposed areas than to those already covered by the particles which provides great uniformity to the coating. Furthermore, corners on the sensor exhibit a higher electrostatic charge than rounded or flat parts of the sensor which further assures good uniformity of the resin coating as it passes about a corner on the housing, where one would ordinarily expect the coating to become thin due to surface characteristics.

When the desired thickness of a coating is achieved on the sensor 26, it may be removed from the cloud of particles at the fluidized bed. The removal step is illustrated schematically at 38 in FIG. 3. The desired thickness may be easily ascertained through design specifications. For example, if the dielectric strength of the insulation on the sensor 26 should be such as to resist 1500 volts, one need only ascertain the dielectric strength of the resin from the manufacturer (usually by resort to product literature). In the usual case, resin will have a dielectric strength of about 400 volts per 1/1000 of an inch. Consequently, a total thickness of about 4/1000 of an inch will be necessary and if it is desired to include a 50% safety factor, the step of removing the sensor 38 will be performed when the accumulated thickness of the particles on the sensor 26 reaches 6/1000 of an inch.

During this process, it is not unlikely that some resin may have accumulated on areas of the switch where the resin is not wanted. One example would be on the leads 28 of the sensor 26. Thus, as a step illustrated at 40 in FIG. 3, there is performed the selective removal of resin from the sensor 26. This may be accomplished by simple brushing or by blowing the unwanted resin off of the sensor with a focused stream of air, when using the 3M product number 5230 product identified previously. Thereafter, the coated sensor 26 may be exposed to heat to cure the resin and fuse it into a unitary mass encapsulating the sensor 26 as indicated at box 42. Of course, if resin need not be removed, one may proceed directly from the step 38 of removing the sensor from the fluidized bed directly to the curing step 42 as indicated by a dotted arrow 44.

After the curing is complete, the sensor 26 may be stored, shipped, etc., as required. Ultimately, the sensor will be installed in the windings of an electrical machine as illustrated by the step 46 in FIG. 3 as, for example, a dynamoelectric machine of the form illustrated in FIGS. 1 and 2. However, it is to be noted that the coated sensors may be used with efficacy in electrical machines other than dynamoelectric machines by insertion within the windings thereof. For example, they may be employed in the windings of solenoids, contactors, transformers, etc. In short, the invention may be used with efficacy in any sort of electrical machine having windings requiring protection from excessive heat.

Figure 4:
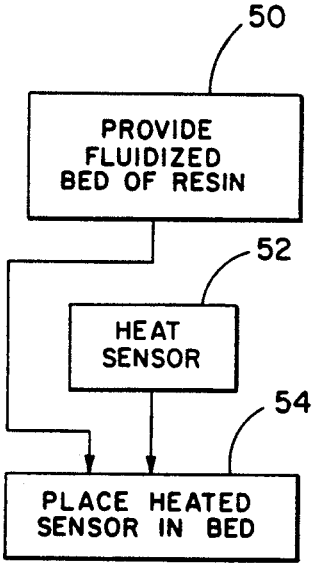
FIG. 4 is a block diagram illustrating part of a modified form of the method.

In some instances, a less preferred form of the invention may be practiced. This form of the invention is illustrated in FIG. 4 wherein the method is initiated by the provision of a fluidized bed of resin as shown by a box 50. In this case, the fluidized bed is not an electrostatic bed but simply a standard fluidized bed wherein the resin is aerated. The sensor 26 is heated to a temperature at which resin particles from the bed will adhere to the housing of the sensor. This is illustrated at the box 52 in FIG. 4.

The heated sensor is then dipped into the fluidized bed of resin particles as illustrated by the box 54. The resin particles, upon contacting the heated sensor 52 will adhere thereto to coat the same. Once the desired coating is complete, the sensor may be removed from the bed and that part of the preferred method shown in FIG. 3 including the steps illustrated at boxes 38, 42, and 46 practiced. In this connection, it should be noted that because the resin is heated to obtain adherence to the sensor, it will be difficult to selectively remove resin so that the step 40 will generally be incapable of being practiced.

The method of the invention is highly desirable because it provides for dry application of the resin. Thus, where the sensors 26 are not in fact truly hermetically sealed, the absence of the use of any liquid in the method precludes the possibility of liquid entering the switch to later interfere with its operation.

It has been determined that use of sensors that have been insulated and sealed according to the invention suffer no problems whatsoever in terms of malfunctions due to the entry of coating material into the switches.

Importantly, the method provides such great uniformity of coating that the total amount of insulation applied to the sensor 26 in the form of resin may be reduced from other prior art methods to the point where response times are approximately halved from the response time of switches that have been encapsulated according to prior art methods. That is to say, because the uniformity of coating is so superior through utilization of the method of the invention, it is not necessary to overcoat part of the sensor to assure that all parts of the sensor have the minimum acceptable thickness. Such overcoating increases the length of the thermal path. As a result, the much shorter thermal path of a sensor made according to the inventive method allows the same to respond to an undesirable temperature condition in approximately half the time or less than prior art encapsulated sensors, thereby providing a substantial enhancement in the protection afforded to the electrical machine with which the sensor is used.

We claim:

1. A method of sealing a bimetallic switch having a nominally sealed housing comprising the steps of;

a) providing an electrostatic fluidized bed of particles of a thermosetting resin at a particular electrical charge;

b) grounding or applying the opposite electrical charge to the housing of the switch to be sealed;

c) locating the switch to be sealed in sufficiently close proximity to the electrostatic fluidized bed as to attract particles thereto;

d) continuing step c) until the switch to be sealed is uniformly coated to a desired depth;

e) removing the switch from said proximity to the electrostatic fluidized bed; and f) curing the resin.

2. The method of claim 1 wherein step e) is followed by and step f) is preceded by the step of removing the resin from unwanted area(s) of the switch.

3. The method of claim 2 wherein the step of removing is performed by brushing the resin particles from the unwanted area(s).

4. The method of claim 2 wherein the step of removing is perforated by blowing the resin particles from the unwanted area(s) of the switch using a focused stream of air.

5. The method of claim 1 wherein step f) is followed by the step of inserting the switch in between coils of an electrical winding.

6. The method of claim 5 wherein the winding is the stator winding of a dynamoelectric machine.

7. The method of claim 1 wherein the resin is an epoxy resin.

8. A method of sealing a bimetallic switch having a nominally sealed housing and comprising the steps of:

a) providing a fluidized bed of resin particles;

b) disposing the switch to be sealed in proximity to the bed;

c) causing particles of resin from the bed to adhere to the switch until a desired thickness of particles on the switch is achieved; and d) fusing the particles into a unitary mass encapsulating the switch.

9. The method of claim 8 wherein step c) is performed utilizing electrostatic atraction.

10. The method of claim 8 wherein step c) is performed by heating the switch to a temperature sufficiently high that resin particles contacting the switch will adhere thereto.

11. The method of claim 8 wherein the resin is a thermosetting resin.

12. A method of sealing and insulating a temperature sensor which includes the steps of:

a) providing a fluidized bed of electrically insulating resin particles;

b) disposing the sensor to be sealed in proximity to the bed;

c) causing particles of the resin from the bed to adhere to the sensor until a desired thickness of particles on the sensor is achieved; and d) fusing the particles into a unitary mass to encapsulate the sensor.

* * * * *